US008150048B2

(12) United States Patent
Chang et al.

(10) Patent No.: US 8,150,048 B2
(45) Date of Patent: Apr. 3, 2012

(54) SYSTEM AND METHOD FOR TESTING AUDIO DEVICE OF MOTHERBOARD

(75) Inventors: Li-Ying Chang, Taipei Hsien (TW); Cho-Hao Wang, Taipei Hsien (TW); Kuan-Lin Wu, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 776 days.

(21) Appl. No.: 12/269,042

(22) Filed: Nov. 12, 2008

(65) Prior Publication Data

US 2009/0323974 A1 Dec. 31, 2009

(30) Foreign Application Priority Data

Jun. 30, 2008 (CN) ..... 2008 1 0302487

(51) Int. Cl.
*H04R 29/00* (2006.01)

(52) U.S. Cl. ..... 381/59; 381/72; 704/500

(58) Field of Classification Search ..... 381/59, 381/72; 704/500
See application file for complete search history.

(56) References Cited

U.S. PATENT DOCUMENTS

| | | | | |
|---|---|---|---|---|
| 3,721,764 | A * | 3/1973 | Dunn | 73/585 |
| 4,833,719 | A * | 5/1989 | Carme et al. | 381/72 |
| 7,370,533 | B2 * | 5/2008 | Davis | 73/585 |
| 2007/0129951 | A1 * | 6/2007 | Tong | 704/500 |
| 2008/0115063 | A1 * | 5/2008 | Glenn | 715/728 |
| 2008/0243211 | A1 * | 10/2008 | Cartwright et al. | 607/63 |
| 2009/0012790 | A1 * | 1/2009 | Yamada et al. | 704/251 |
| 2009/0150007 | A1 * | 6/2009 | Taylor | 701/2 |
| 2010/0318907 | A1 * | 12/2010 | Kaufman et al. | 715/706 |
| 2011/0034228 | A1 * | 2/2011 | Lutnick et al. | 463/16 |
| 2011/0057518 | A1 * | 3/2011 | Gilbert | 307/112 |

FOREIGN PATENT DOCUMENTS

| | | | |
|---|---|---|---|
| CN | 1979440 | A | 6/2007 |
| CN | 101063641 | A | 10/2007 |

* cited by examiner

*Primary Examiner* — A O Williams
(74) *Attorney, Agent, or Firm* — Altis Law Group, Inc.

(57) ABSTRACT

A system for testing audio of a motherboard includes a recording fixture and a computer. The recording fixture includes a recording device and a soundproof device. The soundproof device is configured for soundproofing the audio device and the recording device from environmental noise. The computer includes an output/input module, a comparing module and a displaying module. The output/input module is configured for outputting a first sound signal generated by the computer to the audio device to cause the audio device to generate a sound and receiving the sound generated by the audio device and recorded by the recording device from the recording device and transforming the sound into a second sound signal. The comparing module is configured for comparing the first and second sound signals. The displaying module is configured for displaying the compared result.

9 Claims, 3 Drawing Sheets

SYSTEM AND METHOD FOR TESTING AUDIO DEVICE OF MOTHERBOARD

BACKGROUND

1. Technical Field

The present invention relates to a system and a method for testing an audio device and, more particularly, to a system and a method for testing an audio device of a motherboard.

2. Description of Related Art

A motherboard of a computer usually has an audio device, for example, an audio circuitry of the motherboard to which a speaker or a buzzer is electrically connected with. Traditionally, the audio device is tested by manually listening to a sound generated thereby. The manual test unavoidably will incur manual errors and an inconsistent quality. For example, a tired tester may ignore a failure of an audio device which even totally cannot generate any sound, or let the audio device pass the test when the sound quality is not good enough.

Therefore, a reliable testing system and method for testing an audio device of a motherboard is desirable in order to overcome the described limitations.

SUMMARY

A system for testing an audio device of a motherboard is provided. The system includes a recording fixture and a computer. The recording fixture includes a recording device and a soundproof device. The soundproof device is configured for enclosing the audio device of the motherboard and the recording device therein to soundproof the audio device and the recording device from environmental noise. The computer includes an output/input module, a comparing module and a displaying module for displaying the testing result. The output/input module is configured for outputting a first sound signal generated by the computer to the audio device of the motherboard to cause the audio device to generate a sound and receiving the sound generated by the audio device and recorded by the recording device from the recording device and transforming the sound into a second sound signal. The comparing module is configured for comparing the first and second sound signals. The displaying module is configured for displaying the compared result of the first and second sound signals on a monitor.

A method for testing an audio device of a motherboard is provided. The method includes the steps of: transmitting a first sound signal generated by a computer to the audio device of the motherboard to cause the audio device to generate a sound, recording the sound by a recording fixture and transforming the sound into a second sound signal by the computer, comparing the first and second sound signals by the computer, displaying the compared result on a monitor when the second sound signal is identical to the first signal, for which the audio device passes the test. The test is ended. The method may further comprise a step of asking whether to conduct the test again when the second sound signal is different from the first signal; if the answer is yes, repeating the above steps again. If the answer is no, the audio device does not pass the test and the test is ended.

Other advantages and novel features of the present invention will become more apparent from the following detailed description of preferred embodiments when taken in conjunction with the accompanying drawings.

DETAILED DESCRIPTION OF THE EMBODIMENT

Figure 1:
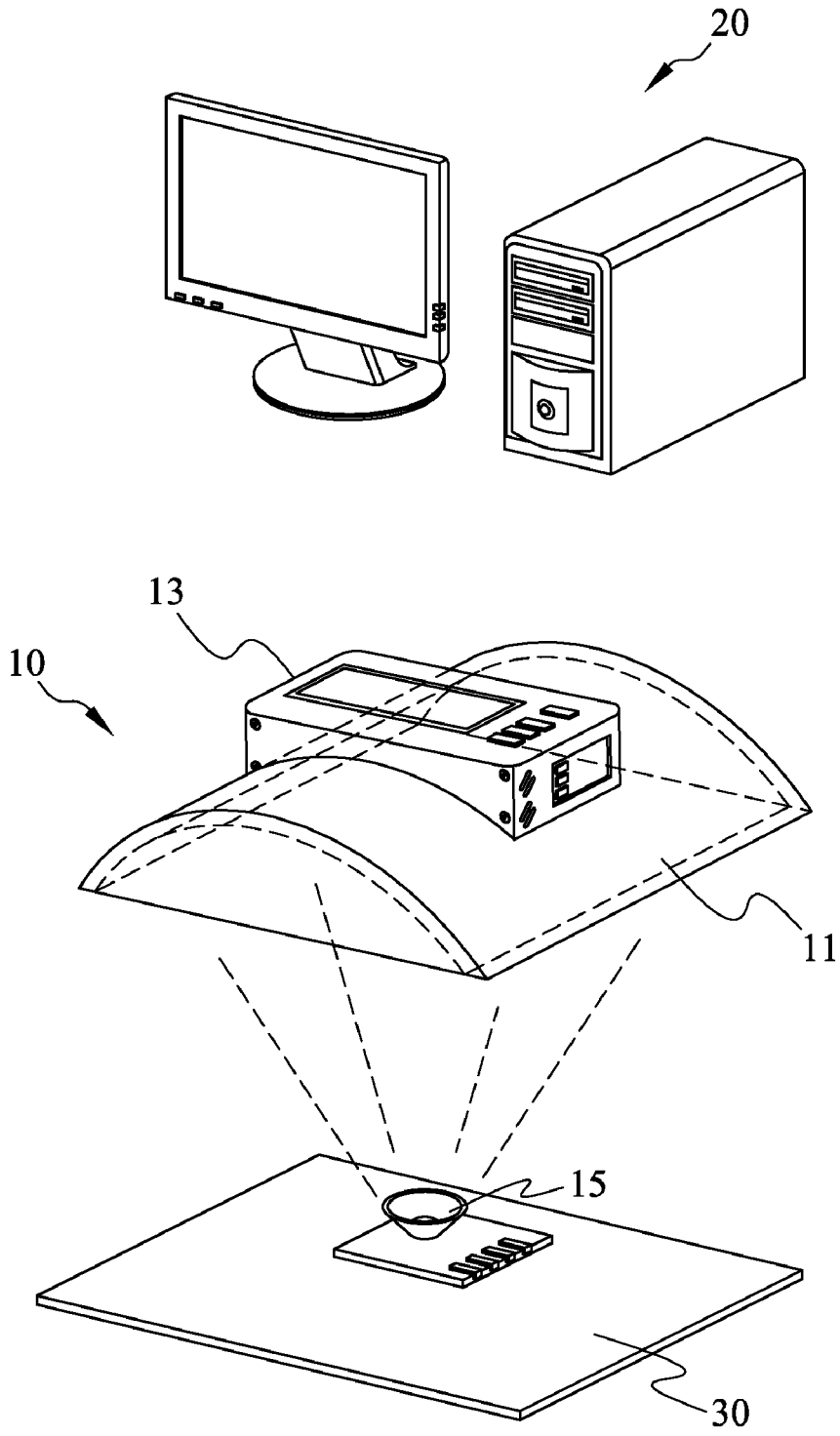
FIG. 1 is a schematic diagram of a system for testing an audio device on a motherboard in accordance with a preferred embodiment and the audio device and the motherboard.

FIG. 1 is a schematic diagram showing a system for testing an audio device on a motherboard 30 in accordance with a preferred embodiment. The audio device is an audio circuitry of the motherboard 30 to which a sounder 15 is electrically connected. The sounder 15 can be a speaker or a buzzer. The system includes a recording fixture 10 and a computer 20. The recording fixture 10 is configured for recording a sound from a sounder 15 on the motherboard 30 and transmitting the sound to the computer 20. The recording fixture 10 includes a soundproof device 11 and a recording device 13. The soundproof device 11 has a lid-shaped configuration. The soundproof device 11 is configured for enclosing the audio device of the motherboard 30 and the recording device 13 therein to soundproof the audio device and the recording device 13 from environmental noise. The recording device 13 is disposed in the soundproof device 11. The recording device 13 is configured for recording the sound from the sounder 15 on the motherboard 30. The sounder 15 can, on one hand, be soldered to the audio circuitry of the motherboard 30 before the test so that the sounder 15 is an on-board component of the motherboard 30, or, on the other hand, be separably connected to the audio circuitry during the test. In the preferred embodiment, the sounder 15 is an on-board component of the motherboard 30. In other words, the audio device in accordance with the preferred embodiment includes the audio circuitry and the sounder 15. The computer 20 is configured for transmitting a first sound signal to the audio device of the motherboard 30 and receiving a sound recorded by the recording fixture 10 from the sounder 15 on the motherboard 30. The first sound signal transmitted from the computer 20 to the audio device is a mono sound signal.

Figure 2:
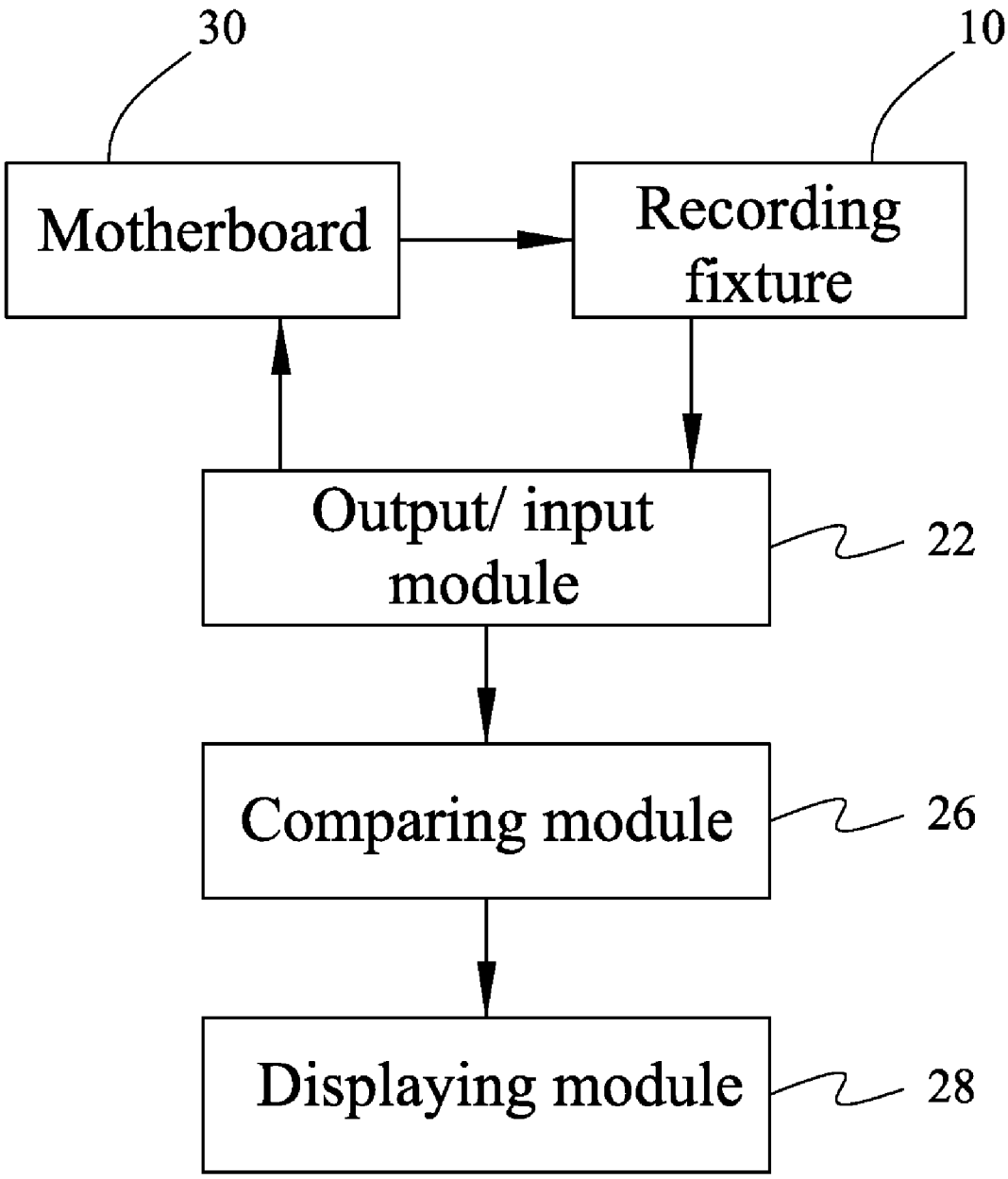
FIG. 2 is a block diagram of function modules of the system of FIG. 1 and the mother board.

FIG. 2 is a block diagram of function modules of the system of FIG. 1 and the motherboard 30 having the audio device mounted thereon. The computer 20 includes an output/input module 22, a comparing module 26, and a displaying module 28.

The output/input module 22 is configured for outputting the first sound signal generated by the computer 20 to the audio device of the motherboard 30 to cause the audio device to generate the sound and receiving the sound generated by the audio device and recorded by the recording device 13 from the recording device 13 and transforming the sound into a second sound signal. The comparing module 26 is configured for comparing the first and second sound signals. The displaying module 28 is configured for displaying the compared result of the first and second sound signals on a monitor.

Figure 3:
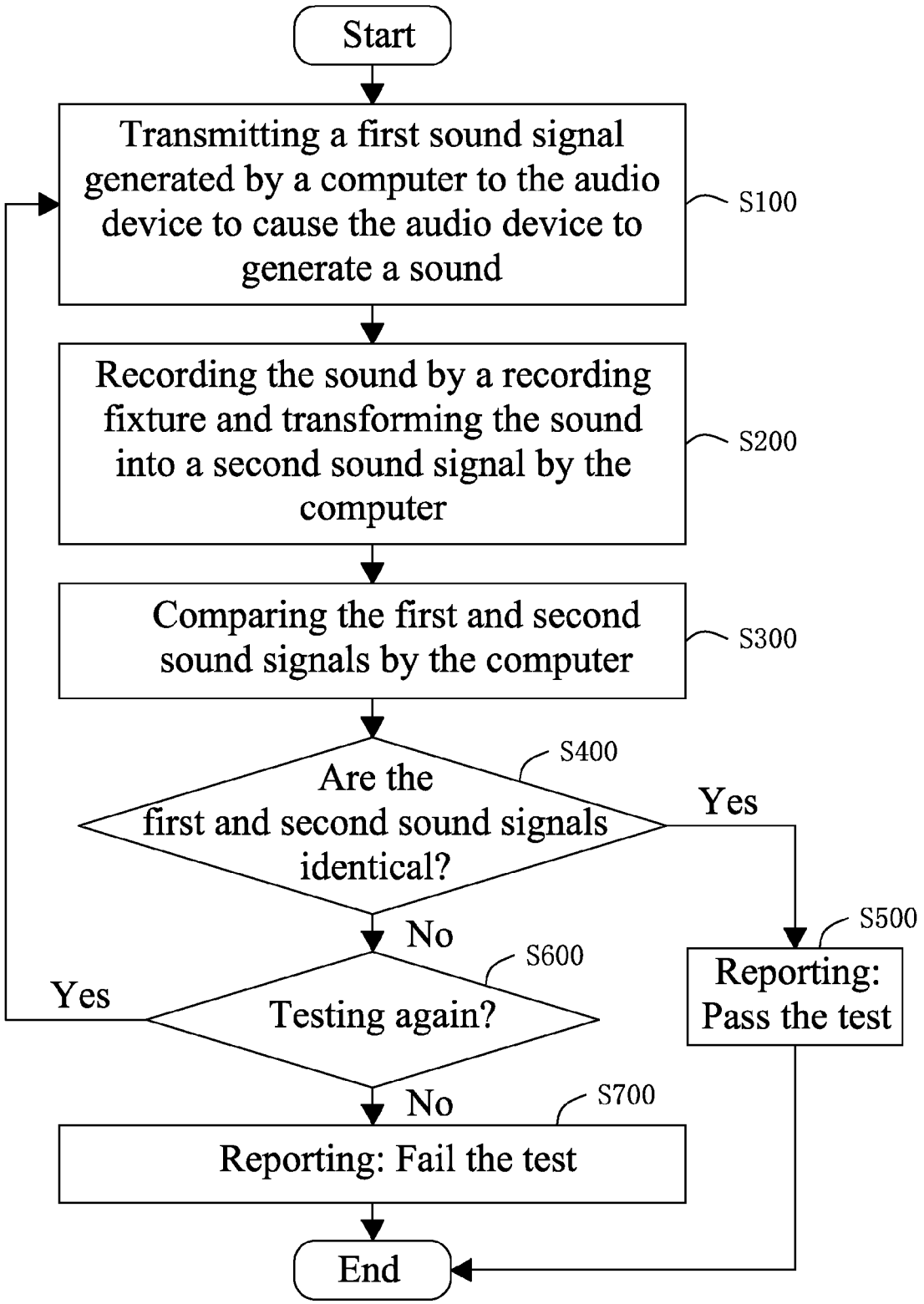
FIG. 3 is a flowchart of a method for testing the audio device on the motherboard in accordance with a preferred embodiment.

FIG. 3 is a flowchart of a method for testing the audio device on the motherboard 30 in accordance with a preferred embodiment. In step S100, the output/input module 22 of the computer 20 transmits a first sound signal generated by the computer 20 to the audio device of the motherboard 30 to cause the audio device to generate a sound.

In step S200, the recording fixture 10 records the sound and transmits the recorded sound to the output/input module 22 of the computer 20. The output/input module 22 of the computer 20 then transforms the sound into a second sound signal. The output/input module 22 then transmits the second sound signal to the comparing module 26 of the computer 20.

In step S300, the comparing module 26 of the computer 20 compares the first and second sound signals of the output/input module 22.

In step S400, the comparing module 26 of the computer 20 compares whether the first and second sound signals are identical. In step S500, the displaying module 28 displays the compared result on the monitor when the second sound signal is identical to the first signal, for which the audio device passes the test. The test is ended. The method may further comprise a step S600 of asking whether to conduct the test again when the second sound signal is different from the first signal, if the answer is yes, then the procedure returns the step S100. If the answer is no, then the procedure goes to the step S700.

In step S700, the displaying module 28 reports that the audio device fails the test and the test is ended; the audio device of the motherboard 30 does not pass the test and must be replaced or repaired.

What is claimed is:

1. A system for testing an audio device of a motherboard, the audio device including an audio circuitry and a sounder electrically connecting with the audio device, the system comprising:

a recording fixture comprising a recording device and a soundproof device, the soundproof device being configured for soundproofing the recording device and the audio device of the motherboard from environmental noise; and a computer comprising:

an output/input module configured for outputting a first sound signal generated by the computer to the audio device of the motherboard to cause the audio device to generate a sound, receiving the sound generated by the audio device and recorded by the recording device from the recording device, and transforming the sound into a second sound signal;

a comparing module configured for comparing the first and second sound signals; and a displaying module configured for displaying the compared result of the first and second sound signals on a monitor.

2. The system as claimed in claim 1, wherein the soundproof device has a lid-shaped configuration.

3. The system as claimed in claim 1, wherein the first sound signal is a mono sound signal.

4. A method for testing an audio device of a motherboard, the method comprising the steps of:

transmitting a first sound signal generated by a computer to the audio device of the motherboard to cause the audio device to generate a sound;

recording the sound by a recording fixture and transforming the sound into a second sound signal by the computer;

comparing the first and second sound signals by the computer; and displaying the compared result on a monitor.

5. The method according to claim 4 further comprising the following step after the displaying step:

displaying the compared result on the monitor indicating that the audio device passes the test when the second sound signal is identical to the first sound signal; and asking whether to conduct the test again when the second sound signal is different from the first sound signal, if the answer is yes, repeating the steps of the method prior to the asking step again, and if the answer is no, displaying the compared result on the monitor indicating that the audio device fails to pass the test.

6. A test assembly comprising:

a mother board having an audio device thereon;

a recording device; and a computer for generating a first sound signal to the audio device to cause the audio device to generate a sound, the sound being recorded by the recording device first and then sent back to the computer, the computer transforming the sent back sound into a second sound signal and comparing the first and sound signals to see whether they are identical to each other and displaying the comparison result on a monitor.

7. The test assembly of claim 6 further comprising a soundproof device soundproofing the audio device and the recording device from environmental noise.

8. The test assembly of claim 6, wherein the audio device includes an audio circuitry on the motherboard and a sounder soldered on the audio circuitry.

9. The test assembly of claim 6, wherein the audio device includes an audio circuitry on the motherboard and a sounder separably electrically connected to the audio circuitry.

* * * * *